US007198359B2

(12) United States Patent
Iwao

(10) Patent No.: US 7,198,359 B2
(45) Date of Patent: Apr. 3, 2007

(54) INKJET HEAD AND INKJET PRINTER

(75) Inventor: Naoto Iwao, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 252 days.

(21) Appl. No.: 11/020,117

(22) Filed: Dec. 27, 2004

(65) Prior Publication Data

US 2005/0140744 A1 Jun. 30, 2005

(30) Foreign Application Priority Data

Dec. 26, 2003 (JP) ..... 2003-434708

(51) Int. Cl.
*B41J 2/045* (2006.01)

(52) U.S. Cl. ..... 347/68; 347/72

(58) Field of Classification Search ..... 347/50, 347/68–72

See application file for complete search history.

(56) References Cited

U.S. PATENT DOCUMENTS 3,683,212 A * 8/1972 Zoltan ..... 310/328
5,402,159 A 3/1995 Takahashi et al.
6,331,052 B1 12/2001 Murai et al.
6,422,685 B1 * 7/2002 Kondo et al. ..... 347/46
6,443,547 B1 * 9/2002 Takahashi et al. ..... 347/9

FOREIGN PATENT DOCUMENTS

JP A 04-341852 11/1992
JP A 05-162313 6/1993
JP A 11-157076 6/1999

* cited by examiner

*Primary Examiner*—Stephen Meier
*Assistant Examiner*—Geoffrey S. Mruk
(74) *Attorney, Agent, or Firm*—Oliff & Berridge, PLC

(57) ABSTRACT

An inkjet head in which cross-talk between adjacent pressure chambers is suppressed. The inkjet head has a channel unit having pressure chambers and nozzles communication with the pressure chambers, and an actuator unit fixed to one surface of the channel unit for changing the volume of the pressure chamber. The actuator unit includes individual electrodes provided opposed to the plurality of pressure chambers for receiving a drive signal to change the volume of the pressure chamber; a common electrode provided over the plurality of pressure chambers; a piezoelectric sheet provided between the individual electrode and the common electrode; and an independent electrode provided between adjacent individual electrodes and electrically isolated from the common electrode and the individual electrodes. An inductor is electrically connected between the independent electrode and a portion whose electric potential is substantially the same as that of the common electrode.

13 Claims, 14 Drawing Sheets

INKJET HEAD AND INKJET PRINTER

BACKGROUND OF THE INVENTION

1. Field of the Invention

The present invention relates to an inkjet head for ejecting ink onto a recording medium and an inkjet printer for performing printing operations with the inkjet head.

2. Description of the Related Art

An inkjet head distributes ink supplied from an ink tank to a plurality of pressure chambers to eject ink through nozzles that are in fluid communication with the pressure chambers by selectively applying pressure in pulses to the pressure chambers one of methods for selectively applying pressure to the pressure chambers is to use an actuator unit formed of a plurality of ceramic piezoelectric sheets laminated together.

One inkjet head having this type of actuator unit is disclosed in Japanese unexamined patent application publication HEI-4-341852 (FIG. 1). The inkjet head has a plurality of individual electrodes disposed opposite a plurality of pressure chambers for changing the volume of the pressure chambers in response to drive signals; a common electrode disposed over the plurality of pressure chambers and maintained at ground potential; and a piezoelectric sheet interposed between the individual electrodes and the common electrode. When the individual electrodes are set at a potential different from that of the common electrode to cause an electric field across the polarizing direction of the piezoelectric sheet, the piezoelectric sheet interposed between the individual electrodes and the common electrode and polarized in the laminating direction of the sheets deform in the laminating direction according to a longitudinal piezoelectric effect. If the directions of the electric field and polarization are the same, then the piezoelectric sheet expands in the laminating direction. This deformation of the piezoelectric sheet changes the volume in the pressure chamber, causing ink to eject through a nozzle in communication with the pressure chamber toward a recording medium.

As the density of pressure chambers continues to increase in this type of inkjet head in recent years in order to meet high resolution and high-speed printing needs, a problem called structural cross-talk has arisen. The structural cross-talk means that deformation in the piezoelectric sheet facing a certain pressure chamber accidentally results in deforming another portion of the sheet facing adjacent pressure chambers. As a result, ink may be ejected from nozzles where such ejection is not intended. The amount of ink intended to be ejected from the target nozzle may be changed.

Due to the structural cross-talk, when ink is ejected from that pressure chamber, the amount of deformation in the piezoelectric sheet facing a given pressure chamber may be changed depending on whether ink is simultaneously ejected from neighboring pressure chambers. Accordingly, the amount of ink ejected from this pressure chamber is not stable.

SUMMARY OF THE INVENTION

In view of the foregoing, it is an object of the present invention to provide an inkjet head that suppress structural cross-talk occurring when the volume of pressure chambers adjacent to the target pressure chamber changes accidentally, by suppressing deformation in the piezoelectric sheet at not-opposing areas which does not face the pressure chambers.

The present invention provides an inkjet head having a channel unit and an actuator unit. The channel unit has a flat shape. The channel unit has a plurality of pressure chambers arranged adjacent to one another in a plane perpendicular to a thickness direction of the channel unit, and a plurality of nozzles provided on a first surface of the channel unit and being in communication with the plurality of pressure chambers. Each of the plurality of pressure chambers has a volume. The actuator unit is fixed to a second surface of the channel unit for changing the volume of each of the plurality of the pressure chambers. The actuator unit has a plurality of individual electrodes, a common electrode, a piezoelectric sheet, and an independent electrode. The plurality of individual electrodes is provided opposed to the plurality of pressure chambers, respectively. Each of the plurality of individual electrodes receives a drive signal to change the volume of corresponding one of the pressure chambers. The common electrode is provided over the plurality of pressure chambers. The piezoelectric sheet is provided between the plurality of the individual electrodes and the common electrode. The independent electrode is provided between adjacent individual electrodes on a non-opposing portion of the piezoelectric sheet that is not opposed to the pressure chambers. The independent electrode is electrically isolated from the common electrode and the plurality of individual electrodes. The inkjet head further has an inductor electrically connected between the independent electrode and a portion whose electric potential is substantially the same as that of the common electrode.

The present invention provides an inkjet printer having an inkjet head. The inkjet head has a channel unit and an actuator unit. The channel unit has a flat shape. The channel unit has a plurality of pressure chambers arranged adjacent to one another in a plane perpendicular to a thickness direction of the channel unit, and a plurality of nozzles provided on a first surface of the channel unit and being in communication with the plurality of pressure chambers. Each of the plurality of pressure chambers has a volume. The actuator unit is fixed to a second surface of the channel unit for changing the volume of each of the plurality of the pressure chambers. The actuator unit has a plurality of individual electrodes, a common electrode, a piezoelectric sheet, and an independent electrode. The plurality of individual electrodes is provided opposed to the plurality of pressure chambers, respectively. Each of the plurality of individual electrodes receives a drive signal to change the volume of corresponding one of the pressure chambers. The common electrode is provided over the plurality of pressure chambers. The piezoelectric sheet is provided between the plurality of the individual electrodes and the common electrode. The independent electrode is provided between adjacent individual electrodes on a non-opposing portion of the piezoelectric sheet that is not opposed to the pressure chambers. The independent electrode is electrically isolated from the common electrode and the plurality of individual electrodes. The inkjet head further has an inductor electrically connected between the independent electrode and a portion whose electric potential is substantially the same as that of the common electrode.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE PREFERRED EMBODIMENTS

An inkjet head according to a first embodiment of the present invention will be described next. It should be noted that the direction expressions such as "front", "rear", "above", "below", "top", and "bottom" are used throughout the description to define the various parts when a printer is disposed in an orientation in which it is intended to be used. The inkjet head according to a first embodiment of the present invention is provided in an inkjet printer (not shown) for ejecting ink onto a paper conveyed in the inkjet printer in order to record images on the paper.

Figure 1:
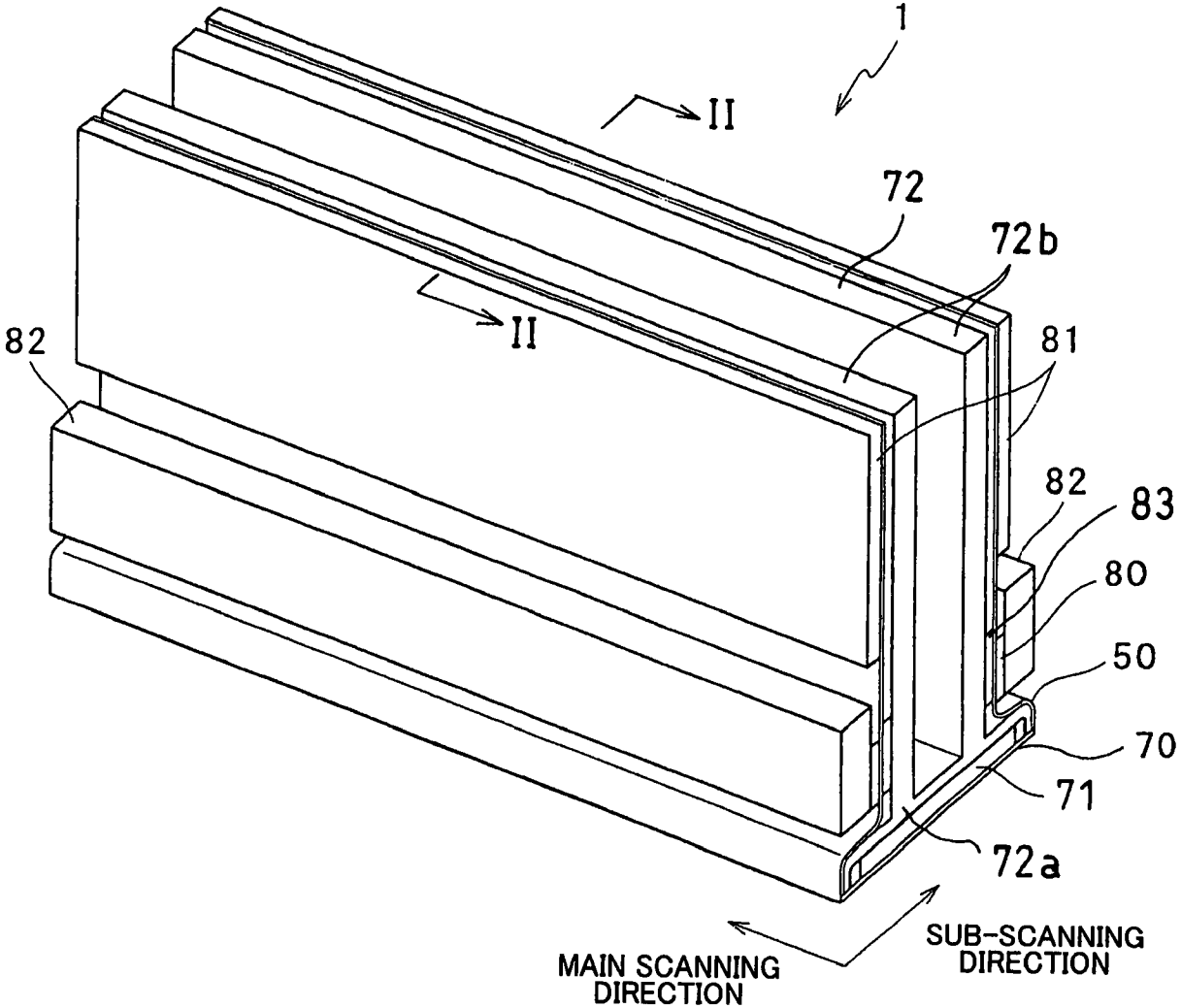
FIG. 1 is a perspective view of an inkjet head according to a first embodiment of the present invention.
Figure 2:
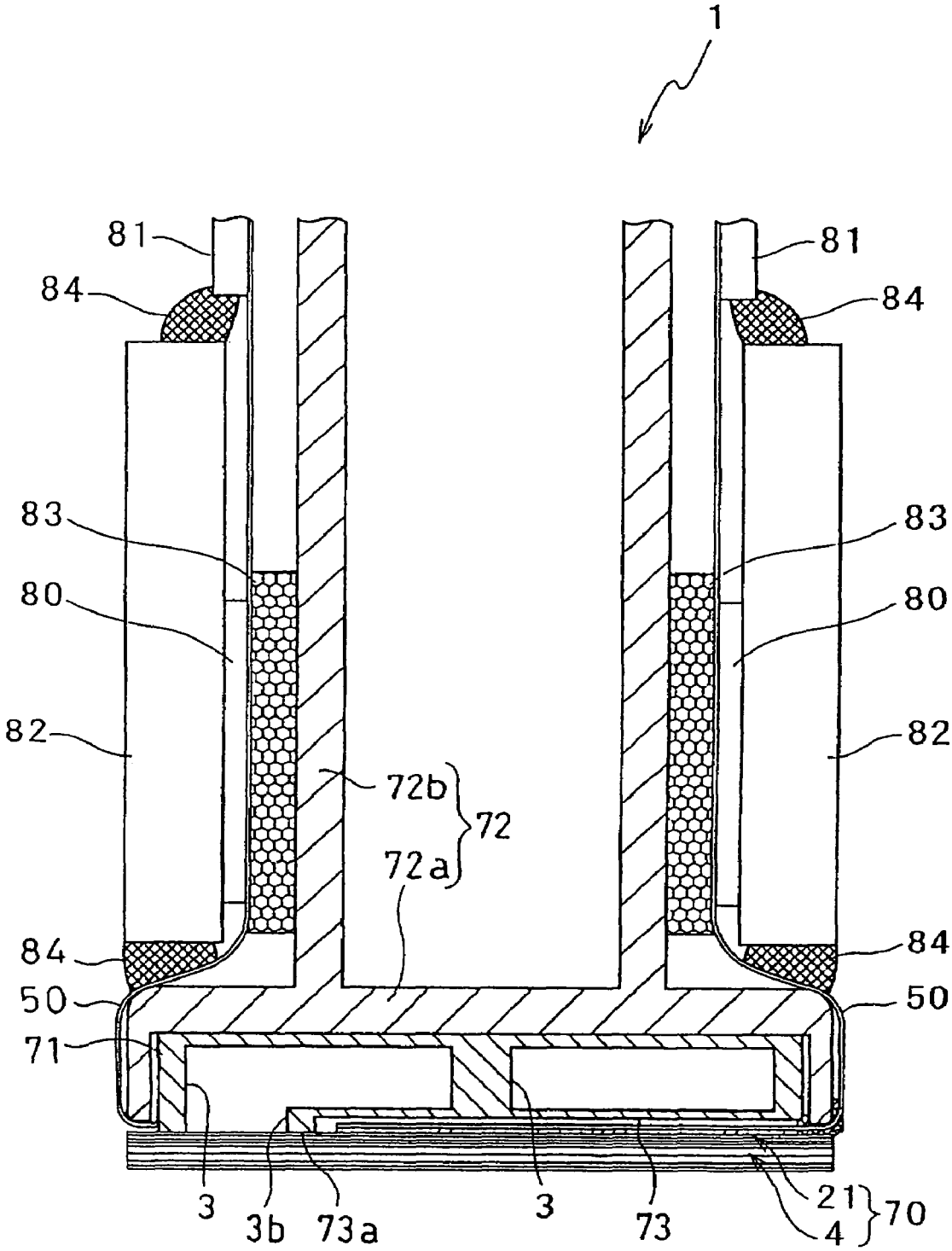
FIG. 2 is a cross-sectional view indicated by lines II in FIG. 1.

FIGS. 1 and 2 show the inkjet head 1 having a main head member 70 for ejecting ink to paper and a base block 71. The main head member 70 has a flat rectangular shape extending in a main scanning direction. The base block 71 has two ink reservoirs 3 for supplying ink to the main head member 70. The two ink reservoirs 3 are positioned above the main head member 70.

The main head member 70 includes: a channel unit 4 in which ink channels are formed; and a plurality of actuator units 21 bonded to a top surface of the channel unit 4. The channel unit 4 and the actuator units 21 have a laminated structure in which a plurality of thin plates are stacked and bonded together. Flexible printed circuits (FPCs) 50 are bonded to the top surfaces of the actuator units 21 for supplying electric power to the same. The FPCs 50 are led out from the actuator units 21 on the both sides thereof. The base block 71 is formed of a metal material such as stainless steel. The ink reservoir 3 is provided inside the base block 71 and includes a hollow portion having a substantially rectangular parallelepiped shape extending in a longitudinal direction of the base block 71.

The bottom surface 73 of the base block 71 protrudes downward from openings 3*b* of the ink reservoir 3. The base block 71 contacts the channel unit 4 only in regions 73*a* around the openings 3*b* on the bottom surface 73. Accordingly, regions other than the openings 3*b* of the bottom surface 73 of the base block 71 are separated from the main head member 70, forming spaces therebetween. The actuator units 21 are disposed in respective these spaces.

The inkjet head 1 includes a holder 72. The holder 72 includes a retaining part 72*a*, and a pair of plate-shaped protruding parts 72*b* protruding perpendicularly to the top surface of the retaining part 72*a* and forming a prescribed gap therebetween. The base block 71 is bonded and fixed in a recess formed in the bottom surface of the retaining part 72*a*. The FPCs 50 bonded to the actuator units 21 are arranged along the surfaces of the protruding parts 72*b* through an elastic material 83 such as a sponge material. A driver IC 80 is provided on each FPC 50 disposed on the surface of the protruding part 72*b* of the holder 72. The FPC 50 is electrically connected by soldering to both the driver IC 80 and the actuator unit 21 for transferring drive signals from the driver IC 80 to the actuator unit 21.

A heat sink 82 substantially shaped like a rectangular parallelepiped is disposed in close contact with the outer surface of the driver IC 80 for efficiently dissipating heat generated by the driver IC 80. A circuit board 81 is disposed on the outer side of each FPC 50 above the driver IC 80 and heat sink 82. Seal members 84 are affixed between the top surface of the heat sink 82 and the circuit board 81 and between the bottom surface of the heat sink 82 and the FPC 50.

Figure 3:
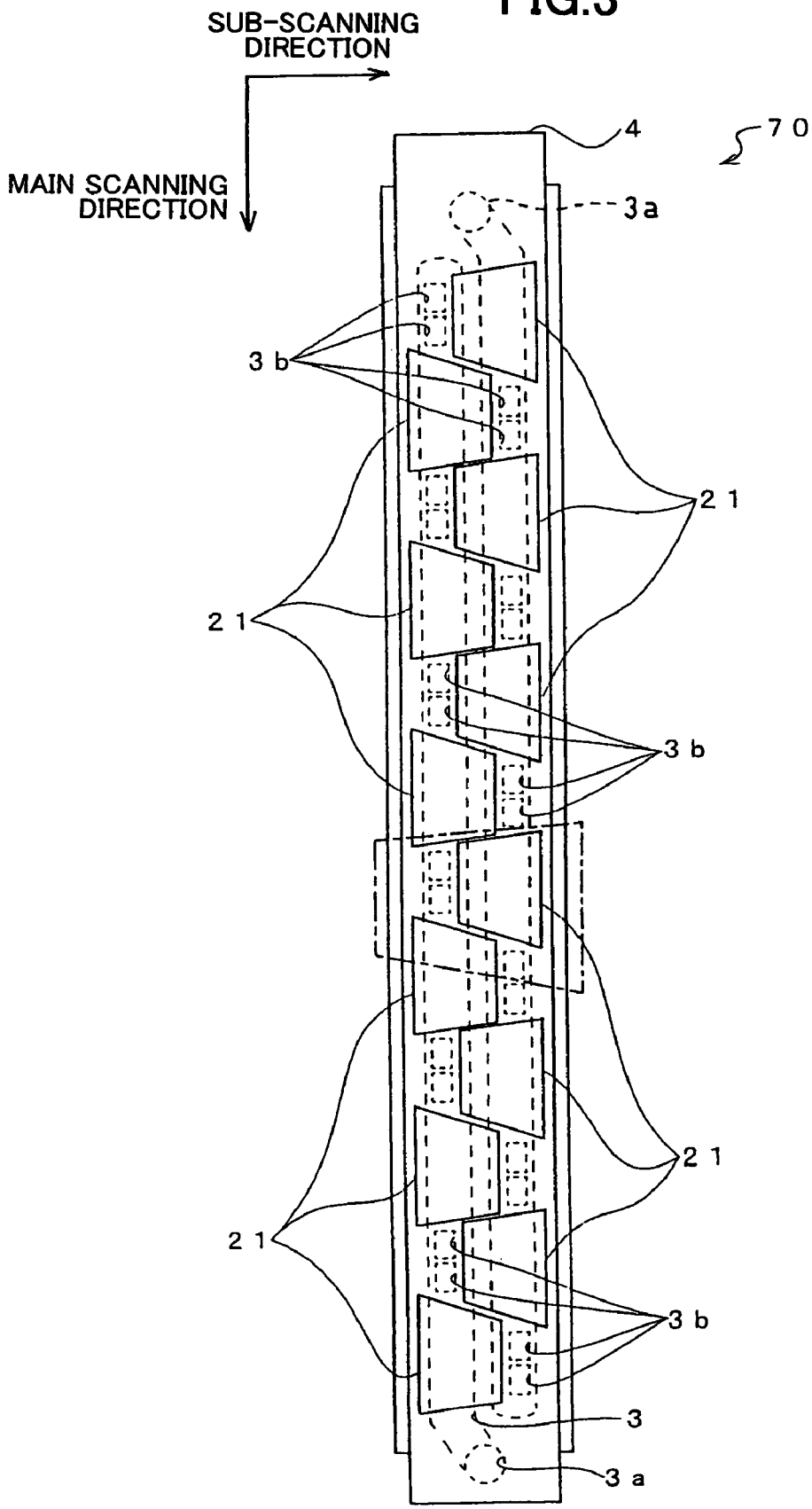
FIG. 3 is a plan view showing a main head.

FIG. 3 is a plan view of the main head 70 shown in FIG. 1. The ink reservoirs 3 formed in the base block 71 are depicted in phantom by dotted lines in FIG. 3. Two ink reservoirs 3 extend in the longitudinal direction of the main head 70 parallel to one another and separated by a prescribed distance. Each of the two ink reservoirs 3 has an opening 3*a* at one end of the base block 71. The ink reservoirs 3 are in fluid communication with an ink tank (not shown) via the openings 3*a*, enabling the ink reservoirs 3 to be full of ink at all times. A plurality of the openings 3*b* are provided in each of the ink reservoirs 3 along the longitudinal direction of the main head 70 for connecting the ink reservoirs 3 to the channel unit 4, as described above. Pairs of openings 3*b* positioned close to one another are disposed in the longitudinal direction of the main head 70. Pairs of openings 3*b* communicating with one ink reservoir 3 are disposed in a staggered relationship with pairs of openings 3*b* communicating with the other ink reservoir 3.

A plurality of the actuator units 21 having a planar trapezoidal shape are arranged in a staggered pattern opposing each pair of openings 3*b* in regions not occupied by the openings 3*b*. The parallel sides (top and bottom sides) of each actuator unit 21 are aligned with the longitudinal direction of the main head 70, while the slanted sides of neighboring actuator units 21 overlap in the widthwise direction of the main head 70.

Figure 4:
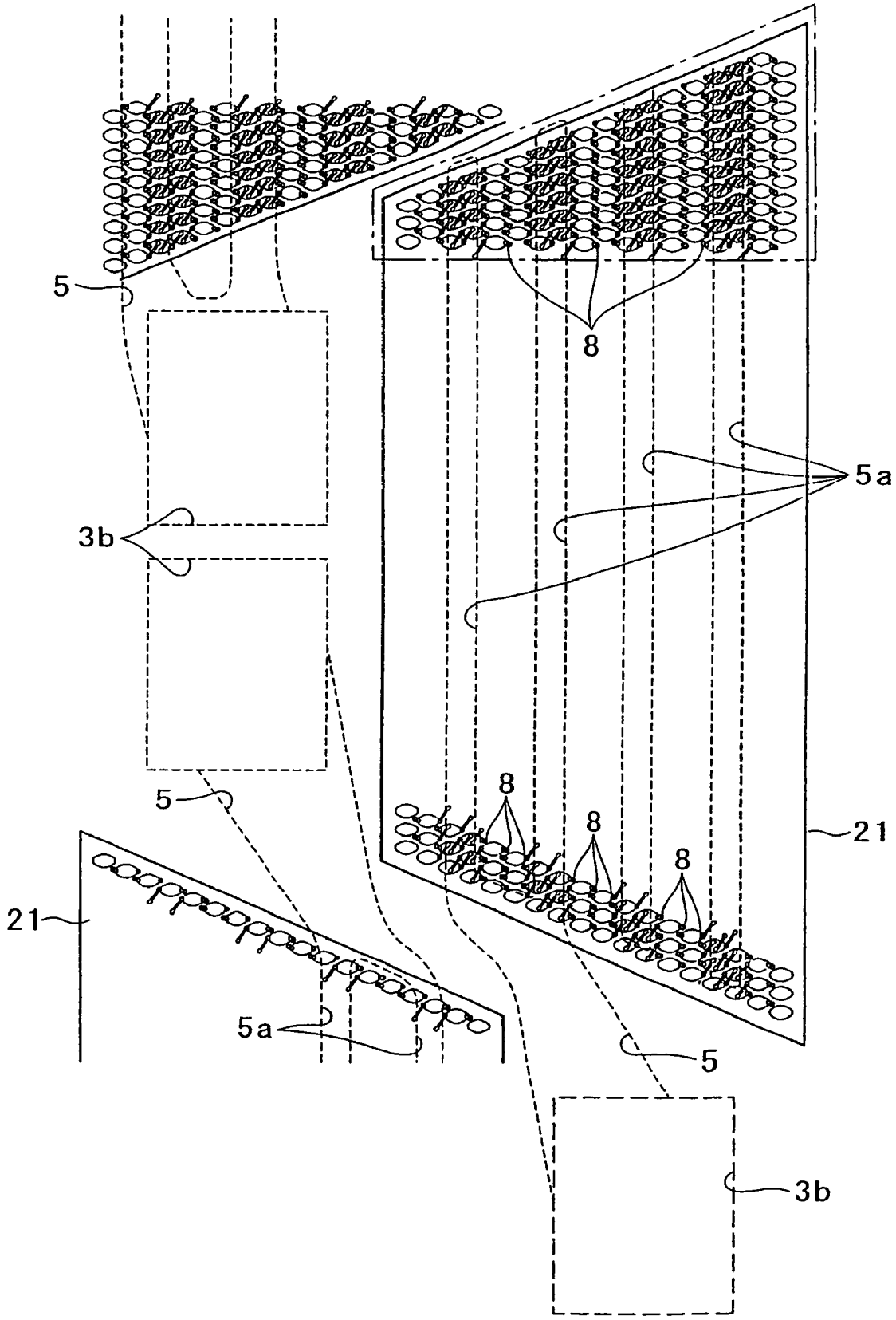
FIG. 4 is an enlarged view showing an area in FIG. 3 delineated by a broken line with alternating long and short dashes.

FIG. 4 is an enlarged view showing a region in FIG. 3 delineated by a broken line with alternating long and short dashes. As shown in FIG. 4, the openings 3*b* provided in the ink reservoirs 3 are in fluid communication with manifolds 5 serving as common ink chambers. The end of each manifold 5 is split into two sub-manifolds 5*a*. In a plan view, two sub-manifolds 5*a* branching from an adjacent opening 3*b* extend through the actuator units 21 from both slanted sides thereof. Hence, a total of four sub-manifolds 5*a* separated from one another extend along the bottom of the actuator unit 21 in the direction of the parallel sides of the actuator unit 21.

Ink ejection regions are formed on the bottom surface of the channel unit 4 facing regions on which the actuator units 21 are bonded. A plurality of nozzles 8 are arranged in a matrix on the surface of the ink ejection regions as described later. For simplification, only a few of the nozzles 8 have been depicted in FIG. 4, while in actuality the nozzles 8 are disposed along the entire ink ejection area of the actuator units 21.

Figure 5:
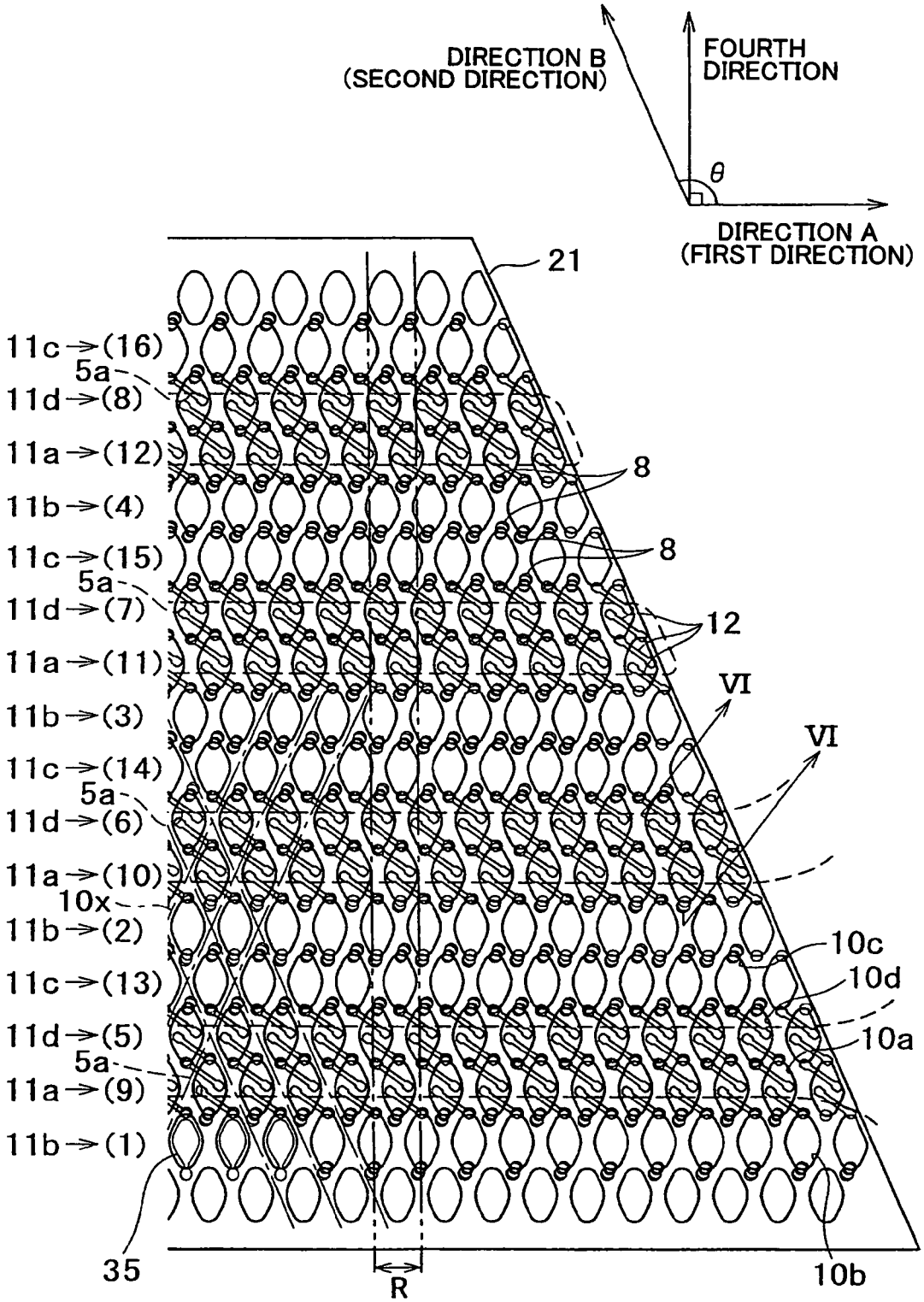
FIG. 5 is an enlarged view showing an area in FIG. 4 delineated by a broken line with alternating long and short dashes.

FIG. 5 is an enlarged view of an area in FIG. 4 delineated by a broken line with alternating long and short dashes. FIGS. 4 and 5 are views in a direction perpendicular to the ink ejection surface and show a plurality of pressure chambers 10 that are arranged in the channel unit 4 in a matrix configuration. Each pressure chamber 10 has a planar and substantially diamond-shape having round corners. A longer diagonal line between opposing corners is parallel to the width direction of the channel unit 4. One end of the pressure chamber 10 is in fluid communication with a nozzle 8, while the other end is in fluid communication with the sub-manifold 5*a* via an aperture 12 (see FIG. 6). In a plan view, individual electrodes 35 having a planar shape similar to but slightly smaller than that of the pressure chambers 10 are formed on top of the actuator unit 21 at positions overlapping each pressure chamber 10. For the sake of description, only a few of the plurality of individual electrode 35 have been depicted in FIG. 5. The pressure chambers 10 and apertures 12 have been depicted with solid lines in FIGS. 4 and 5, although they are beneath the actuator units 21 and should be depicted with dotted lines.

As shown in FIG. 5, a plurality of virtual diamond-shaped regions 10*x* accommodating each of the pressure chambers 10 is arranged in a matrix formation so that rows are formed in the direction A and a direction B with adjacent diamond-shaped regions 10*x* sharing the same sides, but not overlapping. The direction A is the longitudinal direction of the inkjet head 1, that is, the direction in which the sub-manifolds 5*a* extend, and is parallel to the shorter diagonal lines between opposing angles in the diamond shaped regions 10*x*. The direction B is aligned with slanted sides of the diamond shaped regions 10*x* and forms an obtuse angle θ with the direction A. The pressure chambers 10 share the same center point with the opposing diamond shaped regions 10*x*, but the contours of both are spaced apart when seen in a plan view.

Neighboring pressure chambers 10 in this matrix configuration are spaced in the direction A at intervals corresponding to 37.5 dpi. Further, eighteen of the pressure chambers 10 are aligned in the direction B within a single ink ejection area. However, the pressure chambers on both ends in the direction B are dummy chambers and do not contribute to ink ejection.

The plurality of pressure chambers 10 arranged in the matrix configuration form a plurality of pressure chamber rows along the direction A as shown in FIG. 5. When viewed in a direction perpendicular to the surface of the drawing in FIG. 5 (third direction), the pressure chamber rows are divided into first pressure chamber rows 11*a*, second pressure chamber rows 11*b*, third pressure chamber-rows 11*c*, and fourth pressure chamber rows 11*d* in accordance with the relative position to the sub-manifold 5*a*. From the top side of the actuator unit 21 to the bottom side, the four pressure chamber rows 11*a*–11*d* are arranged cyclically in the order 11*c*→11*d*→11*a*→11*b*→11*c*→11*d*→ . . . →11*b*.

In a pressure chamber 10*a* configuring part of the first pressure chamber row 11*a* and the pressure chamber 10*b* configuring part of the second pressure chamber row 11*b*, the nozzles 8 are densely distributed at the bottom of the pressure chambers with respect to a direction orthogonal to the direction A (fourth direction) when viewed in the third direction. The nozzle 8 is positioned on the bottom end of the corresponding diamond-shaped region 10*x*.

However, in a pressure chamber 10*c* configuring part of the third pressure chamber row 11*c* and a pressure chamber 10*d* configuring part of the fourth pressure chamber row 11*d*, the nozzles 8 are densely distributed on the top of the pressure chambers with respect to the fourth direction. The nozzle 8 is positioned on the top end of the corresponding diamond shaped region 10*x*. When viewed in the third direction, a region greater than half the pressure chambers 10*a* and 10*d* overlaps the sub-manifolds 5*a* in the first pressure chamber rows 11*a* and 11*d*. Also when viewed from the third direction, the entire regions of the pressure chambers 10*b* and 10*c* do not overlap the sub-manifolds 5*a* in the second pressure chamber rows 11*b* and 11*c*. For this reason, the nozzles 8 in fluid communication with the pressure chambers 10 belonging to all pressure chamber rows do not overlap the sub-manifolds 5*a*, while the width of the sub-manifolds 5*a* is set as large as possible to smoothly supply ink to the pressure chambers 10.

Figure 6:
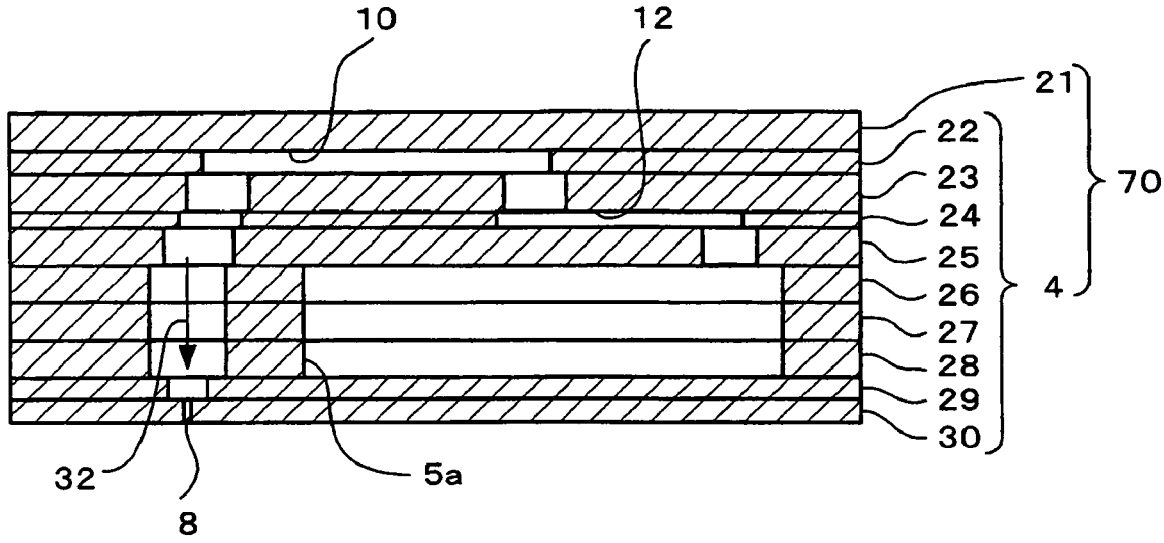
FIG. 6 is a cross-sectional view taken along lines of VI—VI in FIG. 5.

Next, the cross-sectional structure of the main head member 70 will be described referring to FIGS. 6 and 7. FIG. 6 shows the pressure chambers 10*a* in the first pressure chamber rows 11*a*. Referring to FIG. 6, the nozzle 8 is in fluid communication with a submanifold 5*a* via the pressure chamber 10 (10*a*) and an aperture 12. Accordingly, an individual ink channel 32 is formed in the main head member 70 for each pressure chamber 10 and extends from the outlet of the submanifold 5*a* to the nozzle 8 via the aperture 12 and the pressure chamber 10.

Figure 7:
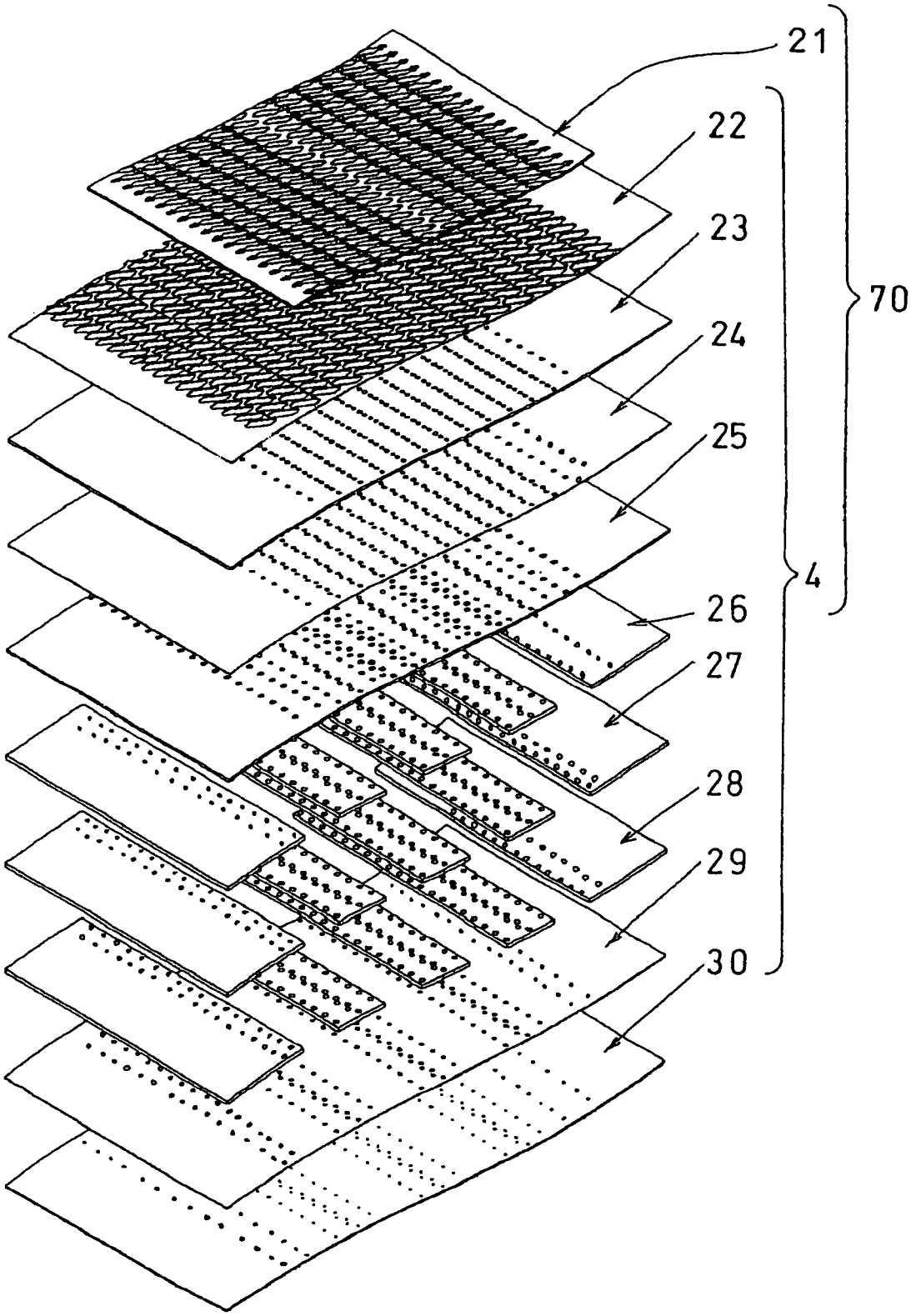
FIG. 7 is an exploded perspective view showing a portion of the main head.

As shown in FIG. 7, the main head member 70 has a laminated structure that includes a total of ten stacked sheets. From top to bottom these sheets include the actuator unit 21, a cavity plate 22, a base plate 23, an aperture plate 24, a supply plate 25, manifold plates 26, 27, and 28, a cover plate 29, and a nozzle plate 30. The channel unit 4 is configured of nine of the above metal plates, excluding the actuator unit 21.

Figure 9:
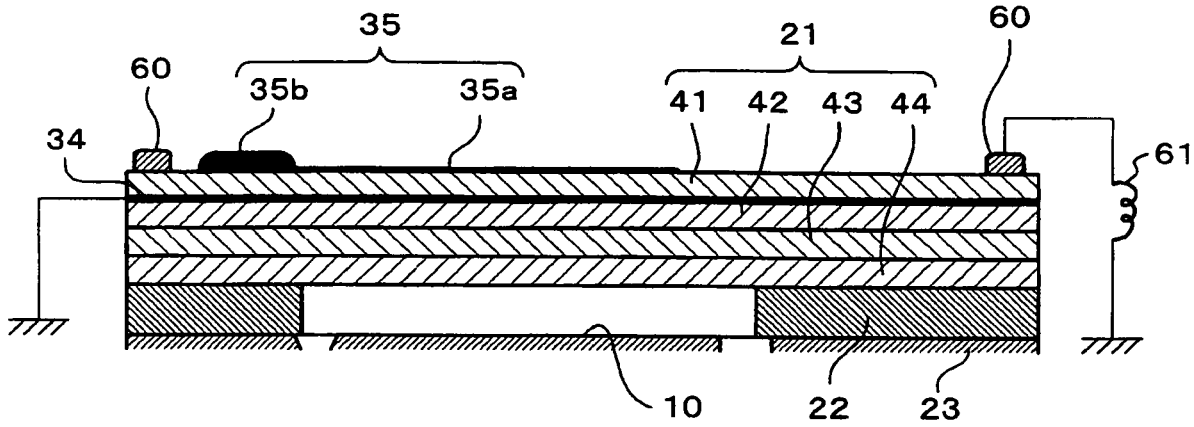
FIG. 9 is a cross-sectional view indicated by lines IX in FIG. 8.

As shown in FIG. 9, the actuator unit 21 includes four laminated piezoelectric sheets 41–44. The topmost sheet of the sheets 41–44 has active layer portions (hereinafter referred to as the "active layer") when a voltage is applied from electrodes, while the remaining three sheets remains inactive layers. The piezoelectric sheets 41–44 are made from a dielectric material and have piezoelectric effect.

Referring to FIG. 6, the cavity plate 22 is made from metal and provided with a plurality of substantially diamond-shaped openings facing the pressure chambers 10. The base plate 23 is made of metal and provided with a communication hole connecting the pressure chamber 10 and aperture 12, and another communication hole connecting the pressure chamber 10 to the ink nozzle 8 for each pressure chamber 10 in the cavity plate 22. The aperture plate 24 is a metal plate provided with the aperture 12 communicating the pressure chamber and the submanifold 5*a*, and a communication hole connecting the pressure chamber 10 and the ink nozzle 8. The holes in the aperture plate 24 is made by etching. The supply plate 25 is a metal plate provided with a communication hole connecting the aperture 12 and the submanifold 5*a,* and a communication hole connecting the pressure chamber 10 and the ink nozzle 8.

The manifold plates 26, 27, and 28 are each provided with a hole for configuring the submanifold 5*a* when the plates are laminated together, and a communication hole connecting the pressure chamber 10 to the nozzle 8. The cover plate 29 is a metal plate provided with a communication hole connecting the pressure chamber 10 to the nozzle 8. The nozzle plate 30 is a metal plate provided with a nozzle 8 for each pressure chamber 10 in the cavity plate 22.

These nine metal plates are aligned and stacked together to form the ink channel 32 shown in FIG. 6. The ink channel 32 begins from the submanifold 5*a* proceeding upward, extends horizontally in the aperture 12 before again proceeding upward, again extends horizontally in the pressure chamber 10, and then proceeds downward to the nozzle 8, first at a slant away from the aperture 12 and then straight downward.

Next, the structure of the actuator unit 21 will be described referring to FIGS. 8 and 9. As shown in FIG. 9, the actuator unit 21 includes the four piezoelectric sheets 41–44, each having the same thickness of approximately 15 μm. These piezoelectric sheets 41–44 are continuous laminated plates (continuous planar layers) that span the plurality of pressure chambers 10 formed in a single ink ejection region of the main head member 70. By disposing the piezoelectric sheets 41–44 as continuous planar layers over the plurality of pressure chambers 10, the electrodes 35 can be densely arranged on the piezoelectric sheet 41 using a screen printing technique. Therefore, the pressure chambers 10 can also be densely arranged at positions corresponding to the electrodes 35, enabling the printing of high-resolution images. The piezoelectric sheets 41–44 are formed of ferroelectric ceramics such as lead zirconate titanate (PZT).

The individual electrodes 35 are formed on top of the piezoelectric sheet 41, the topmost layer. A common electrode 34 formed as a sheet with a uniform thickness of approximately 2 μm is interposed between the piezoelectric sheets 41 and 42. Both the electrodes 35 and the common electrode 34 are formed of a metal material such as Ag—Pd.

Figure 8:
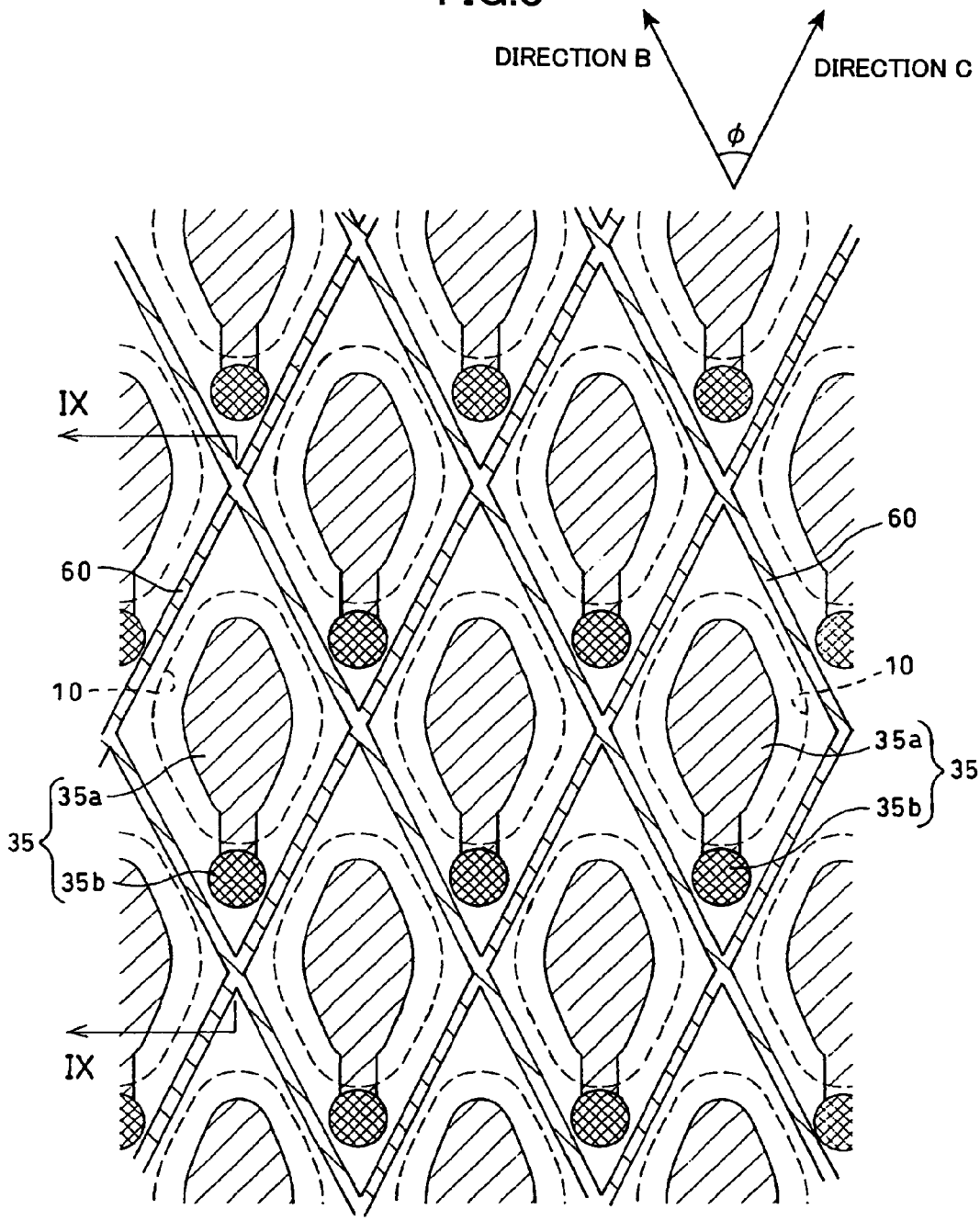
FIG. 8 is an enlarged plan view of an actuator unit.

As shown in FIG. 8, the individual electrodes 35 are arranged in a matrix (see also FIG. 5). Each individual electrode 35 has a main electrode part 35*a* and a land part 35*b* (connection terminal). The main electrode part 35*a* is substantially diamond-shaped (having four sides with opposing sides parallel to one another) similar to the shape of the pressure chamber 10, and has a thickness of approximately 1 μm. The land part 35*b* extends from the main electrode part 35*a* to a region not opposing the pressure chambers 10, and is connected to a signal wire through which drive signals are supplied. As shown in FIG. 8, one acute angle portion of each diamond-shaped main electrode part 35*a* extends in the same direction (downward in FIG. 8). The land part 35*b* extends from this acute angle portion. The land part 35*b* has a circular shape with a diameter of approximately 160 μm, and is electrically connected to the main electrode part 35*a.* The land part 35*b* is formed of gold including glass frit, for example, and is electrically bonded to the surface of the extended part extending from the individual electrode 35. Further, the land part 35*b* is electrically bonded to a contact provided on the FPC 50. Drive signals from the driver ICs 80 (see FIG. 2) are inputted into the main electrode part 35*a* via the land part 35*b* to change the volume of the pressure chamber 10. Further, as shown in FIG. 9, the land part 35*b* is disposed in a region not opposing the pressure chambers 10.

The common electrode 34 is grounded so that all of the common electrodes 34 are maintained equally at a ground potential for all areas corresponding to the pressure chambers 10. Further, the individual electrodes 35 are connected to the driver ICs 80 via the lands 36 and the FPCs 50, which include a plurality of independent lead wires for each individual electrode 35 in order to independently control the potential corresponding to each pressure chamber 10.

Further, an independent electrode 60 is disposed between pairs of neighboring individual electrodes 35 on regions of the piezoelectric sheet 41 that do not oppose the pressure chambers 10. The independent electrode 60 is electrically insulated from the individual electrodes 35 and is grounded to maintain the same potential as that of the common electrode 34. The independent electrode 60 will be described in greater detail below.

Next, a method of driving the actuator unit 21 will be described. The polarizing direction of the piezoelectric sheet 41 is equal to the direction of its thickness. Specifically, the actuator unit 21 has a unimorph structure in which the single piezoelectric sheet 41 on the top side (separated from the pressure chamber 10) has an active layer, while the three piezoelectric sheets 42–44 on the bottom side (near the pressure chamber 10) are inactive layers. Accordingly, when a prescribed positive or negative voltage is applied to the electrode 35, and the directions of the electric field and polarization are the same, areas in the piezoelectric sheet 41 interposed between the electrodes 34 and 36 and over which a voltage is applied function as active layers to compress in a direction orthogonal to the polarizing direction due to the transverse piezoelectric effect.

However, since the piezoelectric sheets 42–44 are not affected by the electric field and therefore do not spontaneously compress, a difference in strain between the piezoelectric sheet 41 and the piezoelectric sheets 42–44 is produced in the direction orthogonal to the polarizing direction, causing all of the piezoelectric sheets 41–44 to deform in a convex shape on the inactive side (unimorph deformation). As shown in FIG. 9, since the bottom surface of the piezoelectric sheets 41–44 is fixed to the top surface of the cavity plate 22, which serves to partition the pressure chambers, the piezoelectric sheets 41–44 effectively deform in a convex shape toward the pressure chamber side. As a result, the capacity of the pressure chamber 10 decreases, increasing the pressure of the ink and causing ink to eject from the nozzle 8. When the individual electrodes 35 are subsequently returned to the same potential as that of the common electrode 34, the piezoelectric sheets 41–44 return to their original shape and the pressure chamber 10 returns to its original capacity, drawing ink in from the manifold 5.

In an alternative method, the individual electrode 35 may be maintained at a different potential from that of the common electrode 34 initially. And, in response to request for ejecting ink, the individual electrode 35 may be temporarily changed to the same potential as that of the common electrode 34, and then subsequently returned to the potential different from that of the common electrode 34 at a prescribed timing. When the individual electrode 35 is changed to the same potential as that of the common electrode 34 in this case, the piezoelectric sheets 41–44 return to their original shape, causing the capacity of the pressure chamber 10 to increase from its initial state in which the potential applied to the individual electrode 35 was different from that of the common electrode 34. As a result, ink from the manifolds 5 is drawn into the pressure chamber 10. Subsequently, when the potential of the individual electrode 35 becomes different from that of the common electrode 34, the piezoelectric sheets 41–44 deform in a convex shape toward the pressure chamber 10, decreasing the volume of the pressure chamber 10 and increasing the pressure on ink therein, causing the ejection of ink.

If the direction of the electric field applied to the piezoelectric sheet 41 is opposite the polarizing direction, the active layer in the piezoelectric sheet 41 interposed between the individual electrode 35 and common electrode 34 will attempt to expand in a direction orthogonal to the polarizing direction by the transverse piezoelectric effect. Accordingly, the piezoelectric sheets 41–44 will deform in a concave shape on the side of the pressure chamber 10, thereby increasing the volume of the pressure chamber 10 and drawing ink in from the manifold 5. Subsequently, when the potential of the individual electrode 35 is returned to normal, the piezoelectric sheets 41–44 return to their original flat shape, which returns the pressure chamber 10 to its original volume and causes ink to eject from the nozzle 8.

Generally, when a drive signal is applied to the individual electrode 35 corresponding to a given pressure chamber 10, a part of the piezoelectric sheet 41 corresponding to the given pressure chamber 10 is deformed in response to the drive signal. However, the deformation of the part of the piezoelectric sheet 41 may simultaneously cause deformation of another part of the piezoelectric sheet 41 corresponding to a neighboring pressure chamber 10. As a result, ink may be ejected from a nozzle not intended for ink ejection, or the resultant amount of ejected ink may be changed. The so-called structural cross-talk happens. In the inkjet head 1 of the first embodiment, the pressure chambers 10 are arranged adjacent to one another in a matrix formation when seen in a plan view. The space between two adjacent pressure chambers 10 is small, so that the structural cross-talk is inevitable.

Referring to FIGS. 8 and 9, the actuator unit 21 further includes an independent electrode 60 and a coil 61 in order to suppress the above cross-talk. The independent electrode 60 is formed on the piezoelectric sheet 41 between neighboring individual electrodes 35. The independent electrode 60 is positioned on non-opposing chamber regions, and extends in a continuous linear manner in an arranging direction B of the pressure chambers 10 and a direction C forming an angle $\phi$ with the direction B. Thus, each individual electrode 35 is surrounded by the independent electrode 60 extending in both the directions B and C. In this embodiment, it should be noted that "a non-opposing chamber region" or "a non-opposing portion" is a portion of the piezoelectric sheets 41–44 which do not oppose the pressure chamber 10.

Further, the independent electrode 60 is electrically insulated from the individual electrodes 35. The independent electrode 60 is connected to a ground through the coil 61. In other words, the coil 61 is electrically connected between the independent electrode 60 and the ground point. In this embodiment, the coil 61 is provided in the driver IC 80 (see FIG. 2), and is connected to the independent electrode 60 via a lead wire.

Figure 10:
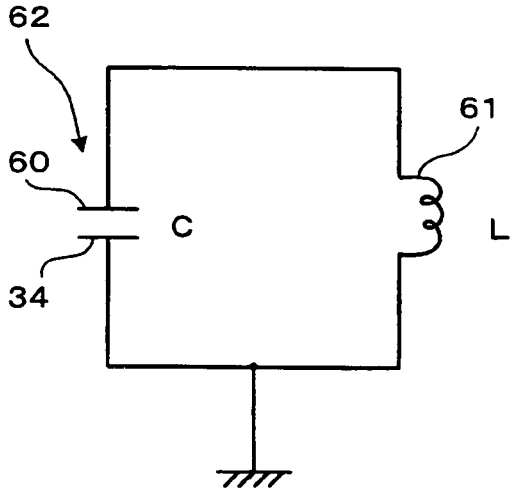
FIG. 10 is a circuit diagram showing an LC parallel circuit formed of a coil and a capacitor, the capacitor formed by interposing a piezoelectric sheet between an individual electrode and a common electrode.

FIG. 10 shows a circuit diagram configured with the common electrode 34, independent electrode 60, and coil 61. As shown in FIG. 10, a capacitor 62 is formed by the electrodes 34 and 60 and a portion of the piezoelectric sheet 41 interposed therebetween. The capacitor 62 forms a close circuit with the coil 61. The close circuit shown in FIG. 10 is a parallel resonance circuit formed by the capacitor 62 and the coil 61.

In the circuit, the parallel resonance caused by the capacitor 62 and coil 61 prevents charge transfer, thereby restricting electrostatic induction in the capacitor 62. Therefore, generation of an electric field in the piezoelectric sheet 41 between the independent electrode 60 and the common electrode 34 is suppressed. This leads to an increase in the mechanical impedance in the non-opposing chamber region. Accordingly, deformation of the piezoelectric sheet 41 between the independent electrode 60 and common electrode 34 is suppressed.

In this embodiment, the pressure chambers 10 are arranged in the matrix configuration. Further each pressure chamber 10 is substantially surrounded by the independent electrode 60 from different directions. Thus, the deformation and/or stress of the pressure chamber 10 can be effectively prevented from acting on neighboring chambers beyond the independent electrode 60 which is close to the pressure chamber 10.

As described above, the deformation of the piezoelectric sheet 41 is suppressed in non-opposing chamber regions. Accordingly, the deformation of the piezoelectric sheet 41 in response to a drive signal to the individual electrode 35 associated with a pressure chamber 10 is prevented from transferring to portions of the piezoelectric sheet 41 opposing another pressure chamber 10.

Suppose that the LC parallel circuit of FIG. 10 formed of the capacitor 62 and coil 61 resonates at a frequency $f_0$. It is preferable that the coil 61 has an inductance L defined by the frequency $f_0$ and the capacitor 62. It should be noted that the frequency $f_0$ is equal to a frequency of the drive signal applied to the individual electrode 35 to excite the corresponding pressure chamber 10. In this case, oscillation having the frequency $f_0$ excites the pressure chamber 10. Here, if we assume $\omega_0$ is the angular frequency of the oscillation exciting the pressure chamber 10 corresponding to the individual electrode 35 ($\omega_0=2\Pi f_0$) and C is the capacitance of the capacitor 62, then an ideal inductance of the coil 61: $L_0=1/(\omega_0^2 \cdot C)$.

On the other hand, an inductance Z of the LC parallel circuit in FIG. 10 is $Z=j\omega L/(1-\omega^2 LC)$. Hence, as L approaches $L_0$, the inductance Z increases and the current flowing in the LC parallel circuit decreases. In other words, since the amount of charge flowing in the piezoelectric sheet 41 interposed between the independent electrode 60 and common electrode 34, i.e., the capacitor 62 is decreasing, this portions of the piezoelectric sheet 41 are less likely to deform.

More specifically, it is preferable for L to be set within a range $\frac{1}{3}L_0<L<3\ L_0$, and more preferable for L to be set nearly equal to $L_0$, so that most charges do not flow in the piezoelectric sheet 41. Since the value of the capacitance C differs depending on the type of the inkjet head 1, a variable coil for adjusting an inductance L can be used as the coil 61.

As described above, the independent electrode 60 extends in continuous linear way in the arranging direction B of the pressure chamber 10 and the direction C that forms the obtuse angle $\phi$ with the direction B. And each of the plurality of individual electrodes 35 is surrounded by the independent electrode 60 extending in these directions B and C. Hence, when a drive signal is applied to a given individual electrode 35 and the piezoelectric sheet 41 corresponding to this individual electrode 35 deforms, deformation of the piezoelectric sheet 41 in the non-opposing chamber region under the independent electrode 60 is suppressed by the increased mechanical inductance due to the coil 61 and capacitor 62. In other words, even when the drive signal is supplied to one individual electrode to deform a corresponding area of the piezoelectric sheet, this deformation is not transferred to the neighboring pressure chambers, thereby reducing structural cross-talk. Accordingly, the piezoelectric sheet 41 under adjacent individual electrodes 35 deforms very little, thereby reliably reducing structural cross-talk. In the preferred embodiment, each of the regions surrounded by the independent electrode 60 including the individual electrode 35 has the same area. Accordingly, even if deformation of the piezoelectric sheet 41 in the non-opposing chamber region close to the individual electrode 35 which a drive signal is applied is not completely suppressed, and this deformation acts on neighboring portions of the piezoelectric sheet 41 corresponding to neighboring individual electrodes 35, the effects of deformation that propagates to the neighboring individual electrodes 35 is substantially equal, thereby reducing irregularity in the amount of ink ejected from a plurality of nozzles in fluid communication with the plurality of pressure chambers 10. Further, since the independent electrode 60 extends in a continuous linear way in the directions B and C of FIG. 8, the independent electrode 60 can be more easily formed on the piezoelectric sheet 41 than when discrete independent electrodes 60 are provided.

In the above embodiment, the common electrode 34 is grounded. However, the common electrode 34 may be connected to a reference potential other than a ground.

Next, modifications of the first embodiment will be described, wherein like parts and components are designated by the same reference numerals to avoid duplicating description.

While the independent electrode 60 in the actuator units 21 of the first embodiment surrounds each individual electrode 35, an independent electrode may be partially provided at a position on a minimum distance between two adjacent individual electrodes 35.

Figure 11:
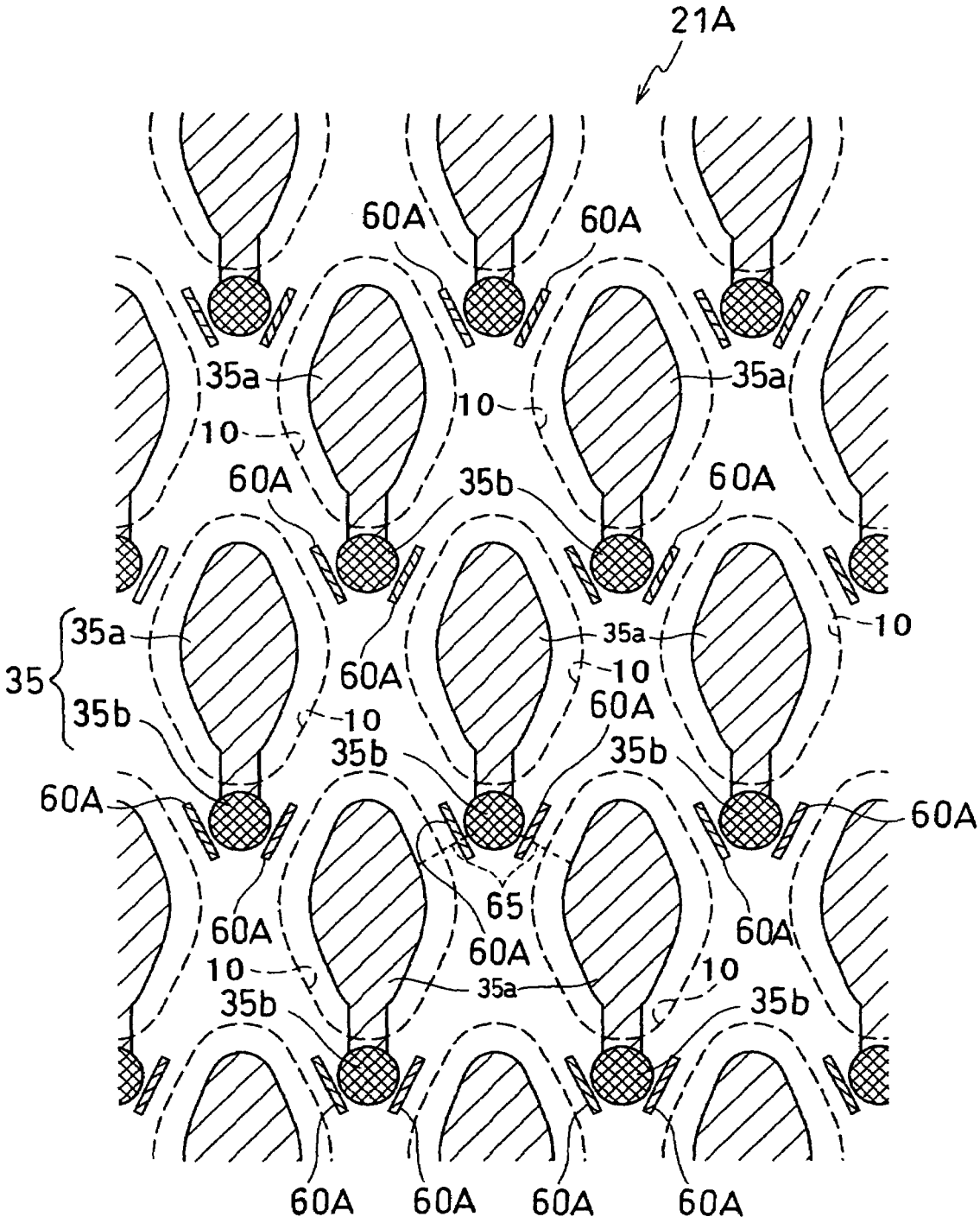
FIG. 11 is an enlarged plan view showing an actuator unit according to a variation of the first embodiment.

As in the first embodiment described above, by arranging the plurality of individual electrodes 35 adjacent to one another in a matrix configuration, the distance between adjacent individual electrodes 35 is shortest at the land parts 35*b*. Therefore, in an actuator unit 21A shown in FIG. 11, independent electrodes 60A extending in the directions B and C may be discreetly provided at positions near the land parts 35*b* overlapping virtual lines 65 that connect two adjacent individual electrodes 35 where they are in closest proximity.

As described above, the independent electrode 60A is formed at a position between two adjacent individual electrodes 35*a* 35*a*, so that deformation of the pressure chamber caused by one of the two individual electrodes is effectively prevented from being transferred to the other pressure chamber corresponding to the other of the two adjacent individual electrodes. Therefore, the structural cross-talk can be reliably reduced.

Figure 12:
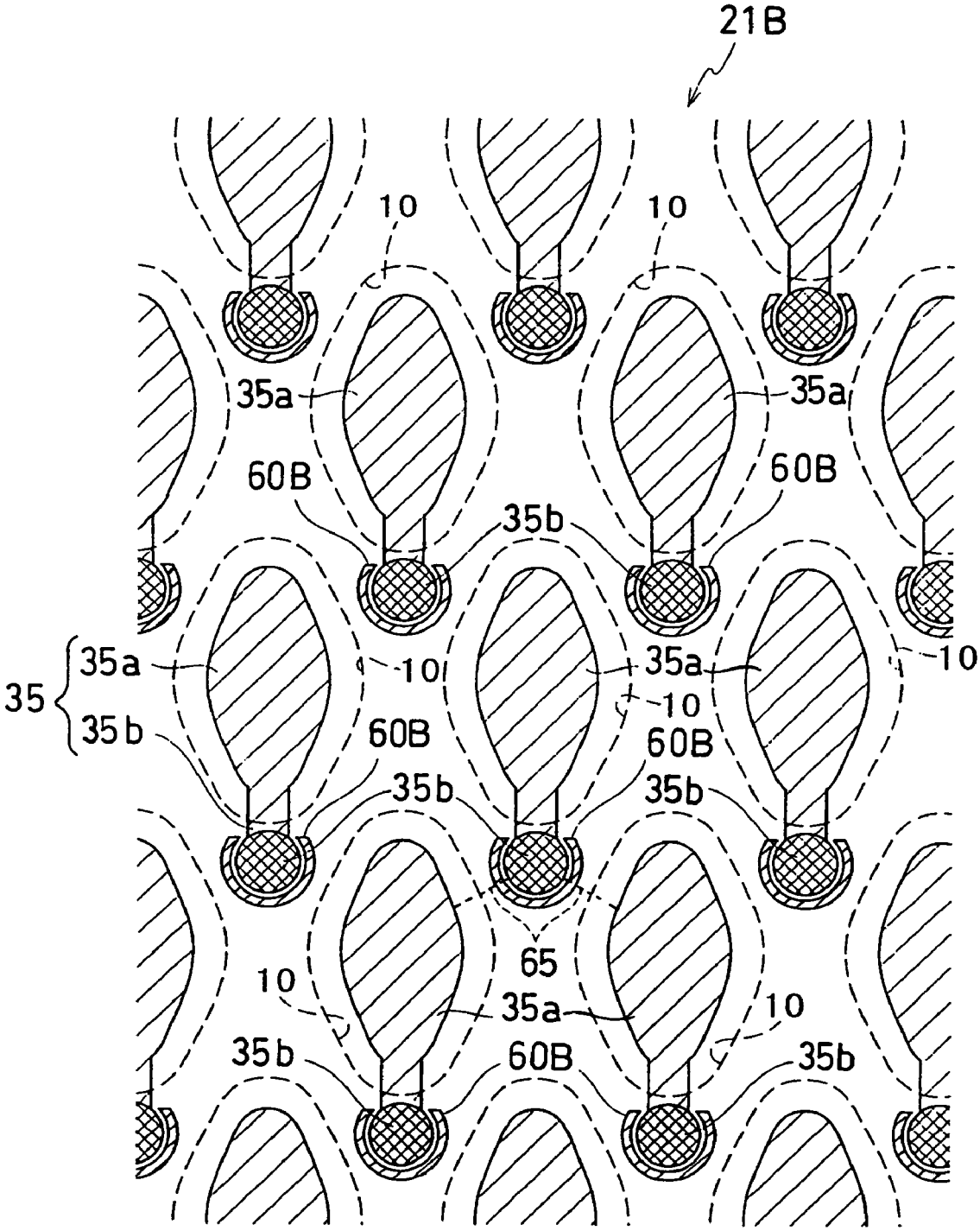
FIG. 12 is an enlarged plan view showing an actuator unit according to another variation of the first embodiment.

Alternatively, in actuator units 21B shown in FIG. 12, independent electrodes 60B shaped like the letter "C" may be provided around the periphery of each land part 35*b* extending from the individual electrode 35 to a position on the non-opposing chamber region.

In either case, a dummy land part (not shown) having substantially the same shape and size as those of the land part 35*b* may be provided on the opposite side of the individual electrode 35 from the land part 35*b*. The dummy land part is electrically connected to the independent electrode 60, and electrically insulated from the individual electrode 35. The independent electrode 60 is electrically connecting to the coil 61 in the FPC 50 through the dummy land part. Accordingly, this structure increases and enhances the joint strength between the FPC 50 and the actuator unit. Further, the above structure will facilitate an electrical connection between the dummy land part and the discretely disposed independent electrodes.

Figure 13:
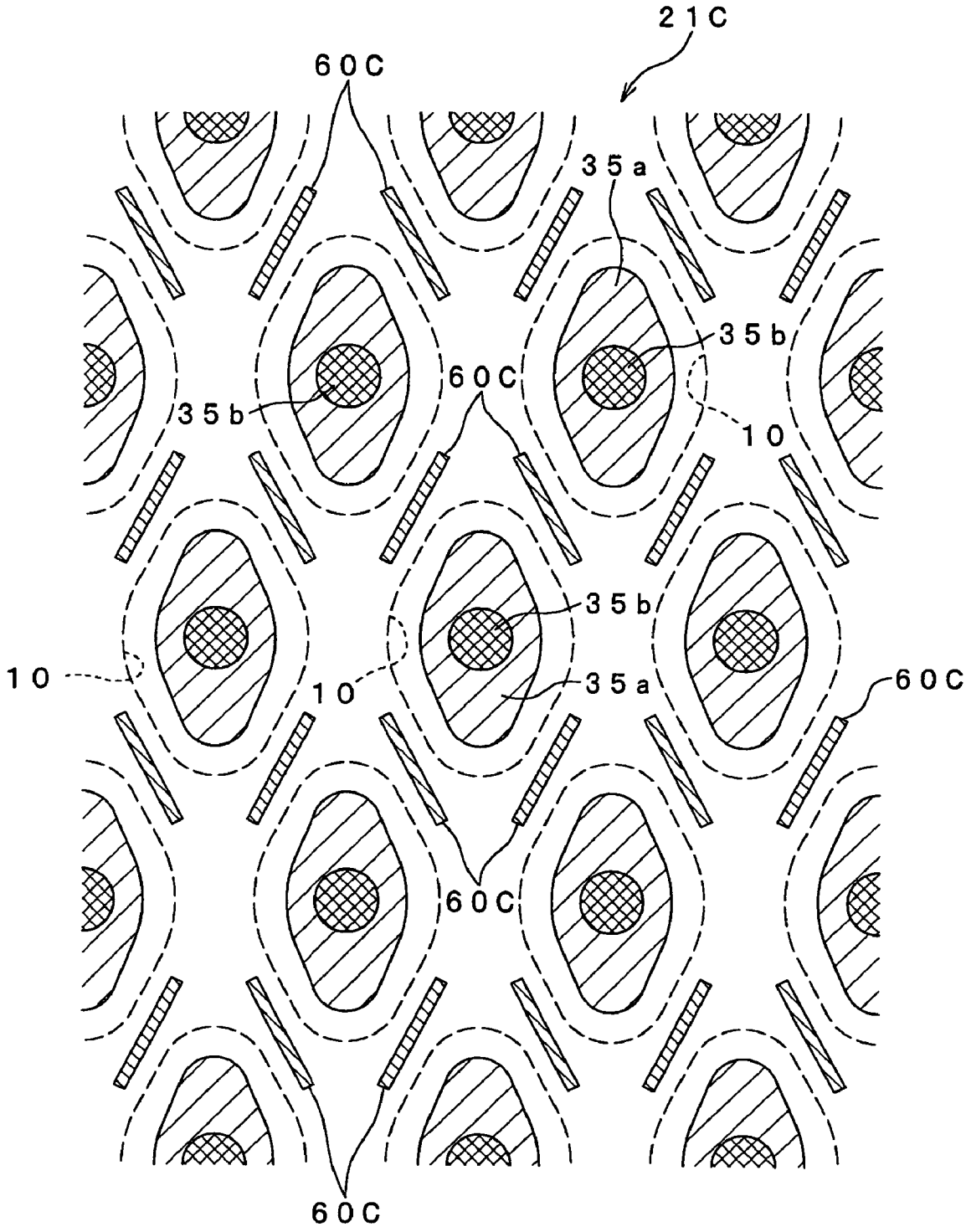
FIG. 13 is an enlarged plan view showing an actuator unit according to another variation of the first embodiment.

FIG. 13 shows another modification of the actuator unit 21C. Referring to FIG. 13, a land part 35*b* is provided in a facing chamber region in which the piezoelectric sheets 41–44 facing the pressure chamber 10. In this embodiment, independent electrodes 60C are provided at positions between main electrode parts 35*a* of neighboring individual electrodes 35 where they are in closest proximity. Alternatively, the independent electrodes 60C may be provided around the main electrode parts 35*a* as in the first embodiment described above.

Figure 14:
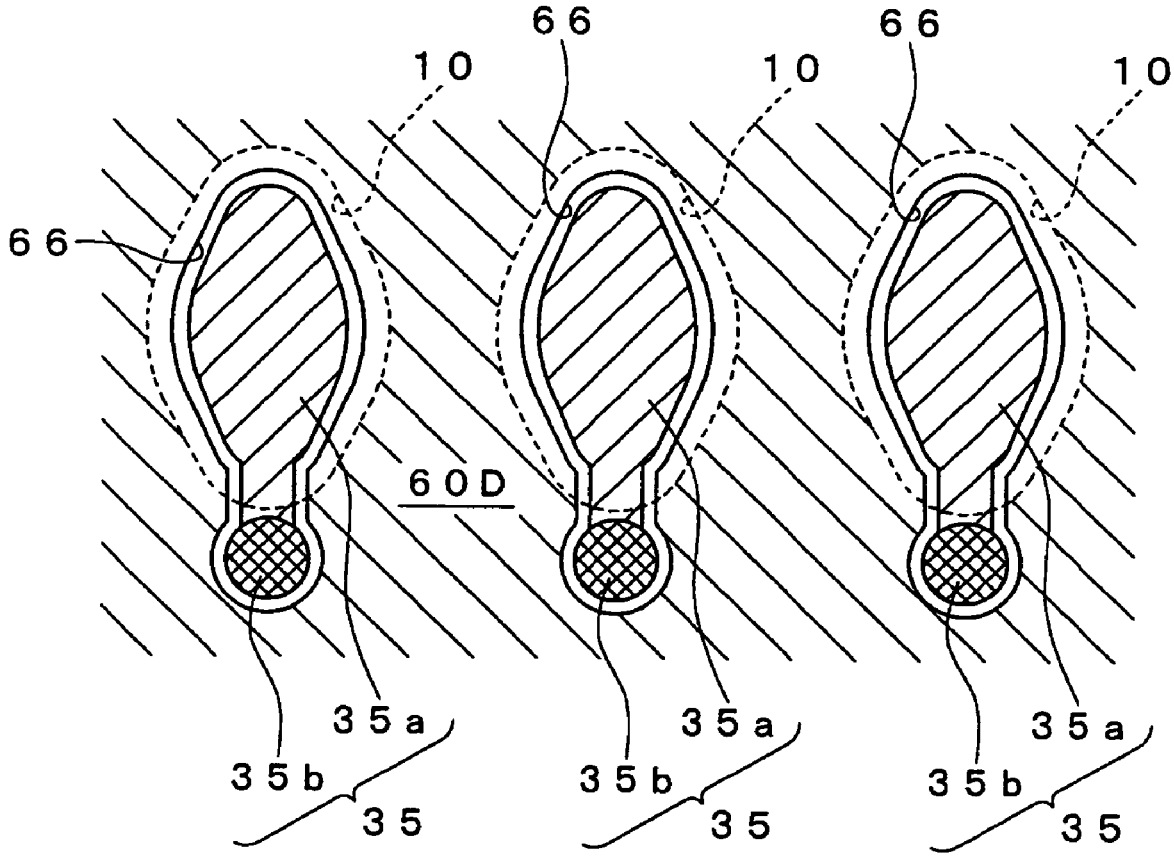
FIG. 14 is an enlarged plan view showing an actuator unit according to another variation of the first embodiment.

FIG. 14 shows further modification of the actuator unit 21D. In the actuator unit 21D, an independent electrode 60D of a conductive layer may be provided over most of the entire surface of the piezoelectric sheet 41 except the individual electrodes 35. One method of forming the independent electrode 60D is to form a conductive layer over the piezoelectric sheet 41 by PVD or electroplating, and subsequently form loop-shaped grooves 66 in the conductive layer by photolithography or laser machining. In this way, the conductive layers on the inner and outer sides of the grooves 66 form the individual electrodes 35 and the independent electrode 60D that are insulated from each other by the grooves 66. By forming the grooves 66 in an area opposing the pressure chamber 10, the individual electrodes 35 are positioned in an area substantially opposing the pressure chambers 10, while the independent electrode 60D may extend from an area not-facing chamber region to an area opposing the pressure chambers 10 but not overlapping the individual electrodes 35. By spreading the independent electrode 60D over the not-facing chamber regions and part of the facing chamber regions opposing the pressure chambers 10 in this way, deformation the piezoelectric sheet 41 not opposing the pressure chambers 10 can be reliably suppressed in order to reduce structural cross-talk.

The inkjet head of the present invention is not limited to the inkjet head described in the first embodiment, wherein the pressure chambers 10 are arranged in a planar matrix structure. For example, the present invention may also be applied to an inkjet head in which pressure chambers are arranged adjacent to one another in lateral rows.

The location of the coil 61 is not limited in the driver IC 80 as described in the first embodiment. The coil 61 may be provided on the outer side of the circuit board 81 and may be connected to the independent electrode 60 by a signal wire separate from the lead wire of the FPC 50. Instead of the coil 61, any component having an inductance in the LC parallel circuit such as a transformer may be used.

Figure 15:
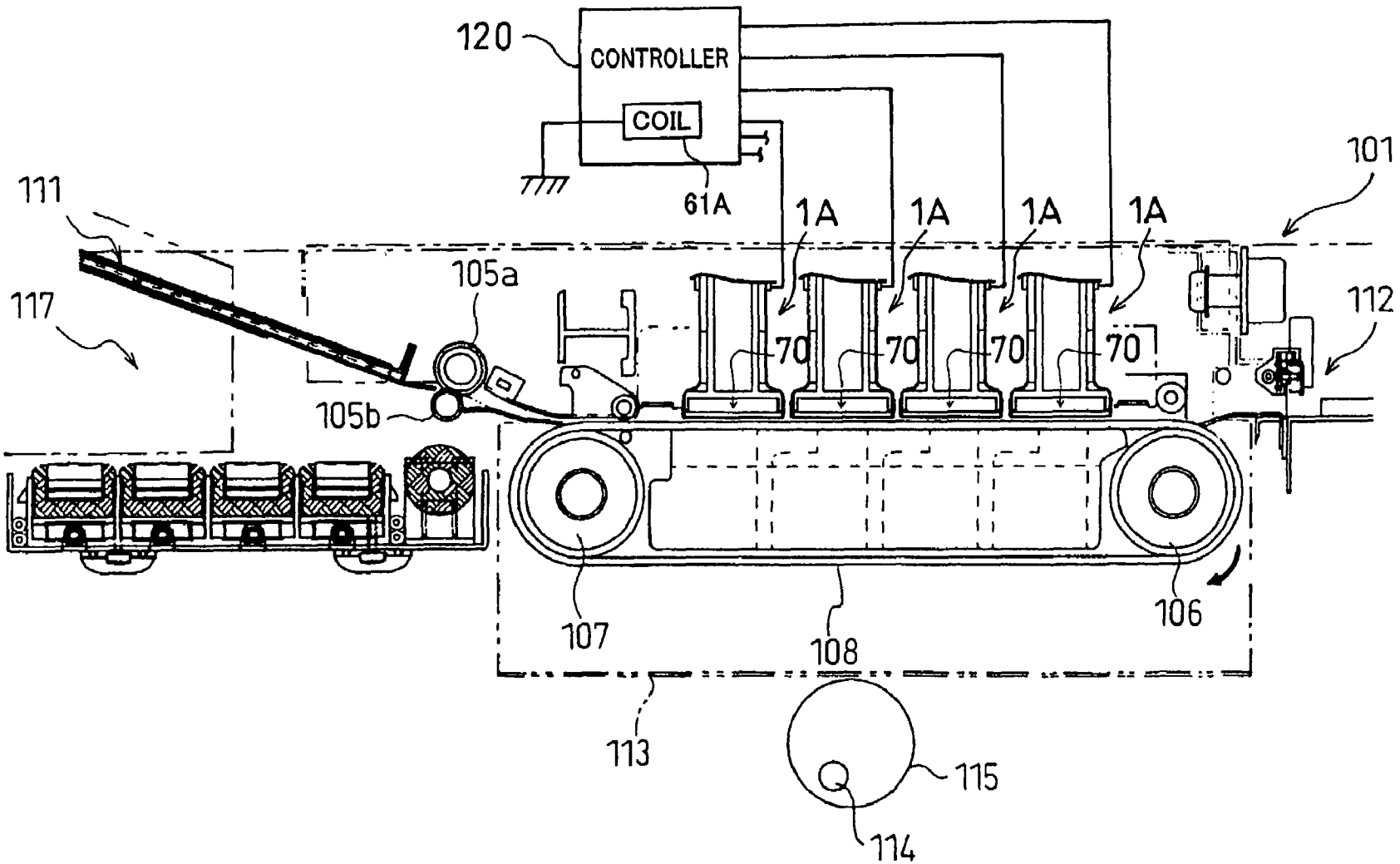
FIG. 15 is a schematic drawing showing the general structure of an inkjet printer according to a second embodiment of the present invention.

Next, an inkjet printer according to a second embodiment of the present invention will be described. FIG. 15 shows the inkjet printer 101 of the second embodiment. The inkjet printer 101 is a color inkjet printer having four inkjet heads 1A. Each of the inkjet heads 1A has the same structure as that of the inkjet head 1 of the first embodiment except the position of the coil 61. The inkjet printer 101 has a paper supply unit 111 and a discharge unit 112.

The inkjet printer 101 has a paper conveying path formed inside for conveying paper from the paper supply unit 111 to the discharge unit 112. A pair of conveying rollers 105*a* and 105*b* for pinching and conveying paper loaded in the paper supply unit 111 is disposed on the downstream side of the paper supply unit 111. Paper is conveyed from the left side of the drawing toward the right by the conveying rollers 105*a* and 105*b*. Two belt rollers 106 and 107 and an endless conveying belt 108 looped around the belt rollers 106 and 107 are disposed in the central area of the paper conveying path. The outer surface of the conveying belt 108, that is, the paper conveying surface, is subjected to a silicon treatment to generate a tackiness on the conveying surface. Paper supplied by the conveying rollers 105*a* and 105*b* is gripped by the tacky conveying surface and conveyed downstream (toward the right) by the clockwise rotation of the belt roller 106 (indicated by the arrow in FIG. 15).

Each of the four inkjet heads 1A is provided with the main head 70 described in the first embodiment on the bottom end thereof and positioned adjacent to one another. The bottom surface of each main head 70 faces the paper conveying path. The nozzles 8 having apertures with a diameter on the micron order described in the first embodiment (see FIG. 7) are provided in the bottom surfaces of the main heads 70 for ejecting ink from the respective main head 70 in the colors magenta, yellow, cyan, and black.

The main heads 70 are disposed such that a small gap is formed between the bottom surfaces of the main heads 70 and the conveying surface of the conveying belt 108. In the small gap, the paper conveying path is formed. With this construction, ink of each color is ejected from the nozzles 8 toward the top surface of the paper, that is, the printing surface, as the paper conveyed on the conveying belt 108 passes directly under each of the main heads 70 in sequence, thereby forming a desired color image on the paper.

The inkjet printer 101 is also provided with a maintenance unit 117 for automatically performing maintenance on the inkjet heads 1A. Further, the belt rollers 106 and 107 and the conveying belt 108 are supported in a casing 113. When the maintenance unit 117 performs a maintenance operation, a shaft 114 eccentrically positioned in a cylindrical member 115 is rotated to change the height of the cylindrical member 115 in order to raise and lower the chassis 113.

The inkjet printer 101 is also provided with a controller 120 for controlling various operations of the inkjet printer 101, such as the ejection of ink from the four inkjet heads 1A and the conveying of paper by the belt rollers 106 and 107. The controller 120 is provided with a coil 61A connected to the independent electrode 60 in the actuator unit 21 described above (see FIGS. 8 and 9). The independent electrode 60 is grounded via the coil 61A.

Hence, as in the first embodiment described above, a circuit is formed of the coil 61 and capacitor 62, which is formed of the piezoelectric sheet 41 interposed between the independent electrode 60 and common electrode 34 (see FIG. 10). Mechanical inductance increases through interaction between the capacitor 62 and coil 61, thereby suppressing deformation of the piezoelectric sheet 41 interposed between the independent electrode 60 and the common electrode 34. A description of the other operations and effects of the inkjet printer will be omitted as they are similar to the first embodiment described above.

What is claimed is:

1. An inkjet head comprising:

a channel unit having a flat shape, the channel unit having a plurality of pressure chambers arranged adjacent to one another in a plane perpendicular to a thickness direction of the channel unit, and a plurality of nozzles provided on a first surface of the channel unit and being in communication with the plurality of pressure chambers, each of the plurality of pressure chambers having a volume; and an actuator unit fixed to a second surface of the channel unit for changing the volume of each of the plurality of the pressure chambers;

the actuator unit comprising:

a plurality of individual electrodes provided, opposed to the plurality of pressure chambers, respectively, each of the plurality of individual electrodes receiving a drive signal to change the volume of corresponding one of the pressure chambers;

a common electrode provided over the plurality of pressure chambers;

a piezoelectric sheet provided between the plurality of the individual electrodes and the common electrode; and an independent electrode provided between adjacent individual electrodes on a non-opposing portion of the piezoelectric sheet that is not opposed to the pressure chambers, the independent electrode being physically isolated from the common electrode and the plurality of individual electrodes; and the inkjet head further comprising: an inductor electrically connected between the independent electrode and a portion whose electric potential is substantially a same as that of the common electrode.

2. The inkjet head according to claim 1, wherein the plurality of pressure chambers is arranged adjacent to one another in a matrix configuration within the plane.

3. The inkjet head according to claim 1, wherein each of the plurality of individual electrodes, the common electrode, and the piezoelectric sheet therebetween form a capacitor, the capacitor and the inductor form a parallel resonance circuit resonating at a predetermined frequency at which one of the plurality of pressure chambers oscillates in response to the driving signal, the inductor has an inductance L within a range of $\frac{1}{3}L_0<L<3L_0$ provided that the inductor has an inductance $L_0$ at the predetermined frequency.

4. The inkjet head according to claim 3, wherein the inductance L of the inductor is substantially equal to $L_0$.

5. The inkjet head according to claim 1, wherein the independent electrode extends linearly in a prescribed direction on the non-opposing portion of the piezoelectric sheet which does not oppose the pressure chambers.

6. The inkjet head according to claim 1, wherein the independent electrode is provided at a position on a minimum distance between two adjacent individual electrodes.

7. The inkjet head according to claim 1, wherein each of the plurality of individual electrodes is surrounded by the independent electrode.

8. The inkjet head according to claim 7, wherein portions of the piezoelectric sheet surrounded by the independent electrode and including each of the plurality of individual electrodes have the same area to each other.

9. The inkjet head according to claim 1, wherein the individual electrodes is provided substantially within a portion of the piezoelectric sheet that is opposed to the pressure chambers; and the independent electrode extends from the non-opposing portion to an opposing portion of the piezoelectric sheet that is opposed to one of the plurality of pressure chambers not so as to overlap one of the plurality of individual electrodes.

10. The inkjet head according to claim 1, wherein each of the plurality of individual electrodes has: a main electrode part opposing one of the plurality of pressure chambers; and a connecting terminal extending from the main electrode part to the non-opposing portion for guiding the drive signals to the main electrode part, and the independent electrode is provided surrounding the connecting terminal.

11. The inkjet head according to claim 1, wherein the independent electrode is opposed to the common electrode through the piezoelectric sheet, the piezoelectric sheet is made from dielectric material.

12. The inkjet head according to claim 1, wherein the common electrode is grounded and the inductor is electrically connected between the independent electrode and ground.

13. An inkjet printer comprising an inkjet head, the inkjet head having:

a channel unit having a flat shape, the channel unit having a plurality of pressure chambers arranged adjacent to one another in a plane perpendicular to a thickness direction of the channel unit, and a plurality of nozzles provided on a first surface of the channel unit and being in communication with the plurality of pressure chambers, each of the plurality of pressure chambers having a volume; and an actuator unit fixed to a second surface of the channel unit for changing the volume of each of the plurality of the pressure chambers;

the actuator unit comprising:

a plurality of individual electrodes provided, opposed to the plurality of pressure chambers, respectively, each of the plurality of individual electrodes receiving a drive signal to change the volume of corresponding one of the pressure chambers;

a common electrode provided over the plurality of pressure chambers;

a piezoelectric sheet provided between the plurality of the individual electrodes and the common electrode; and an independent electrode provided between adjacent individual electrodes on a non-opposing portion of the piezoelectric sheet that is not opposed to the pressure chambers, the independent electrode being physically isolated from the common electrode and the plurality of individual electrodes; and the inkjet head further comprising: an inductor electrically connected between the independent electrode and a portion whose electric potential is substantially a same as that of the common electrode.

* * * * *